US007234972B1

(12) United States Patent
Lai

(10) Patent No.: US 7,234,972 B1
(45) Date of Patent: Jun. 26, 2007

(54) CARD CONNECTOR CAPABLE OF GUIDING SMALL CARD

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/636,981

(22) Filed: Dec. 12, 2006

(30) Foreign Application Priority Data

Sep. 29, 2006 (TW) ..... 952174850 U

(51) Int. Cl.
*H01R 24/00* (2006.01)

(52) U.S. Cl. ..... 439/630

(58) Field of Classification Search ..... 439/630, 439/633, 64, 377
See application file for complete search history.

(56) References Cited

U.S. PATENT DOCUMENTS 6,068,516 A * 5/2000 Chang ..... 439/633
7,083,441 B1 * 8/2006 Lee ..... 439/148
2002/0102882 A1 * 8/2002 Tanaka ..... 439/630
2006/0205278 A1 * 9/2006 Kuo et al. ..... 439/630

* cited by examiner

*Primary Examiner*—Phuong Dinh
(74) *Attorney, Agent, or Firm*—Bacon & Thomas, PLLC

(57) ABSTRACT

A card connector includes a housing; a connection base mounted to the housing and having a plurality of terminals for corresponding connection with an inserted card; and an inclined guide member mounted in the housing. The housing further includes a guide piece located at a top side thereof. The guide piece has a front guide section extending rearward and downward from the housing, a limit section extending horizontally rearward from the front guide section, and a rear guide section extending rearward and upward from the limit section. The rear guide section at a rear end thereof is connected with the housing. Accordingly, the guide piece can guide an inserted small card for correct insertion.

4 Claims, 11 Drawing Sheets

CARD CONNECTOR CAPABLE OF GUIDING SMALL CARD

BACKGROUND OF THE INVENTION

1. Field of the Invention

The present invention relates generally to the card connector technology, and more particularly, to a card connector capable of guiding a small card.

2. Description of the Related Art

A conventional card connector adapted for connection with an Express card (E card) having two specifications, i.e. small and large E cards, includes an L-shaped internal chamber for conformity to the small and large E cards. The large E card is L-shaped and the small E card is long rectangular.

While the large card is inserted, because the card connector conforms to the large E-card in shape, no problem will happen. However, the opening of the card connector is wider than that of the small card, while the small card is inserted, it happens easily that the small card is not aligned with its correct insertion position. In light of this, the card connector further includes an inclined guide member mounted therein for guiding the small card to the correct position while the small card is inserted.

Nevertheless, the conventional card connector at a front wider part thereof is open without any limit and there is though the inclined guide member, but the user may feel that the small card is guided slantwise to have an illusion of askew insertion while the small card is inserted.

SUMMARY OF THE INVENTION

The primary objective of the present invention is to provide a card connector, which enhances the guidance of the small card to guide the small card for correct insertion.

The foregoing objective of the present invention is attained by the card connector composed of a housing, a connection base, and an inclined guide member. The housing includes an insertion entrance formed at a front end thereof, a first sidewall formed at one side therein, and a second sidewall and a third sidewall, both of which are formed at the other opposite side therein to the first sidewall. A narrow chamber is defined at a rear section in the housing and between the first and second sidewalls. A wide chamber is defined at a front section in the housing and between the first and third sidewalls. The connection base is mounted to an inner rear end of the housing, having a plurality of terminals for corresponding connection with an inserted card. The inclined guide member is mounted to the wide chamber and located close to the third sidewall. The housing further includes a guide piece located at a top side thereof and above the wide chamber and corresponding to the second sidewall. The guide piece has a front guide section extending rearward and downward from the housing toward the first sidewall for a predetermined length, a limit section extending horizontally rearward from the front guide section for a predetermined length, and a rear guide section extending rearward and upward from the limit section toward the third sidewall for a predetermined length. The rear guide section at a rear end thereof is connected with the housing. Accordingly, the present invention employs the guide piece to guide an inserted small card for correct insertion therein.

DETAILED DESCRIPTION OF PREFERRED EMBODIMENTS

Figure 1:
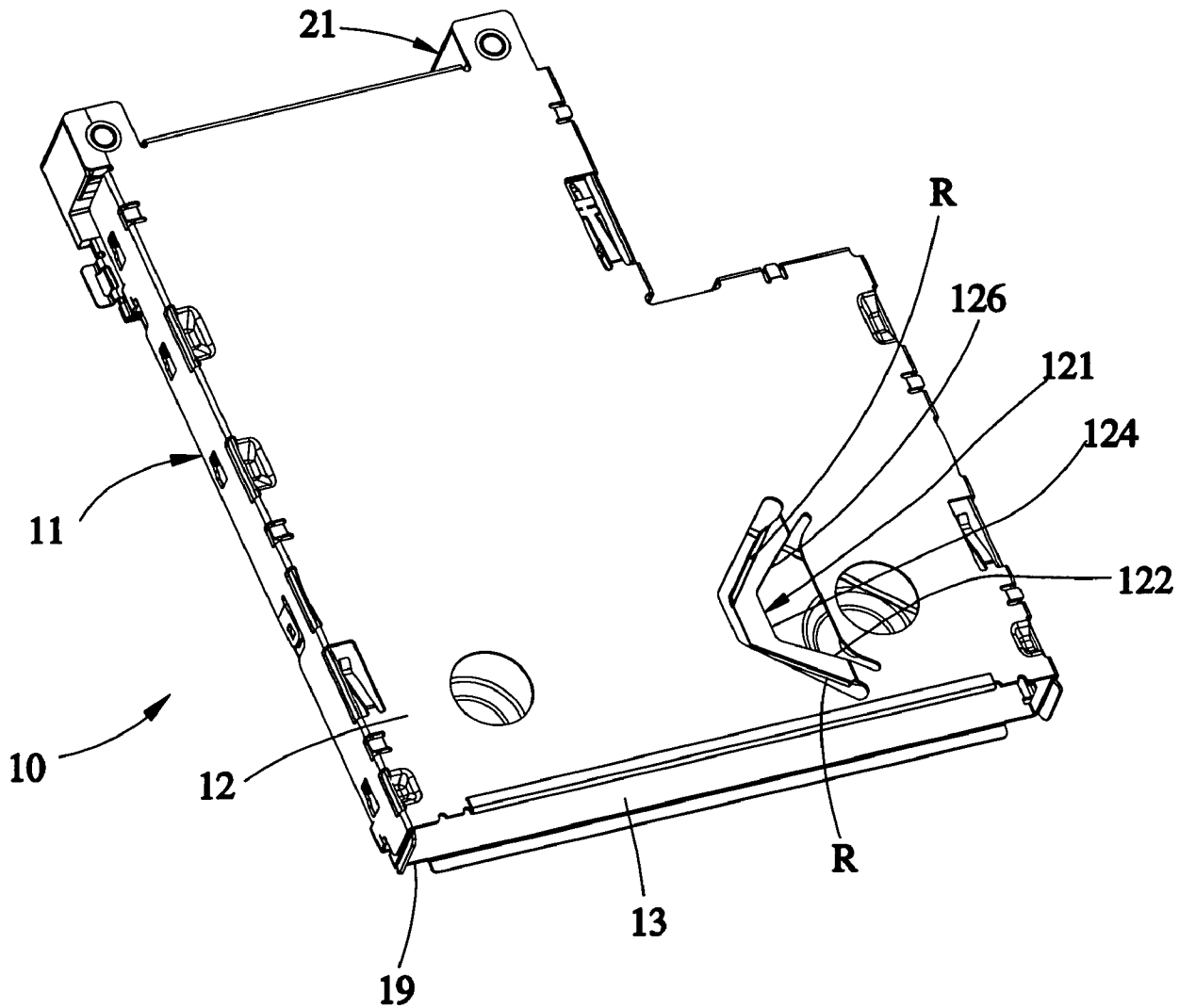
FIG. 1 is a perspective view of a preferred embodiment of the present invention.
Figure 2:
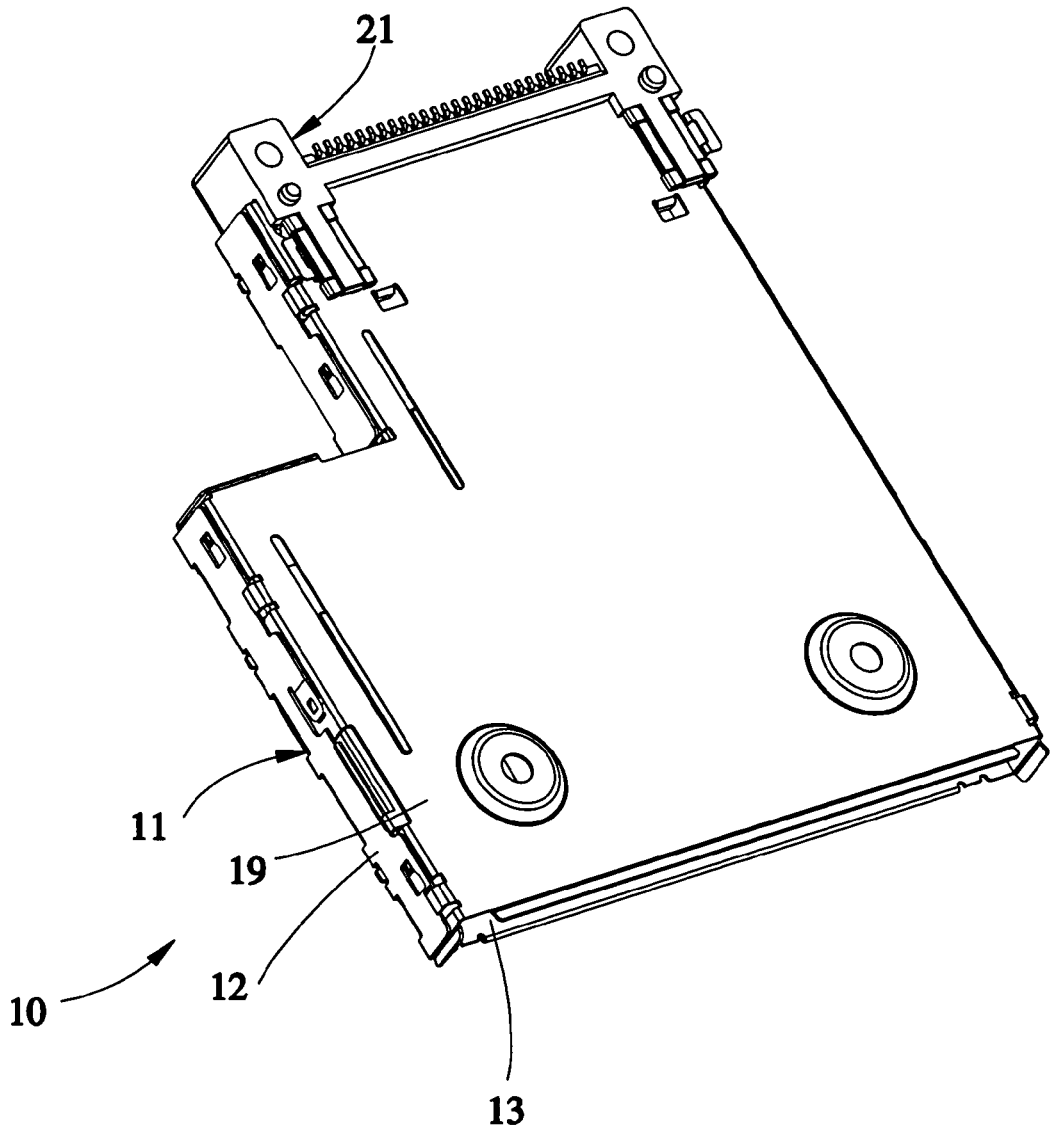
FIG. 2 is a perspective bottom view of the preferred embodiment of the present invention.

Referring to FIGS. 1-6, a card connector 10 capable of guiding a small card, constructed according to a preferred embodiment of the present invention, is composed of a housing 11, a connection base 21, and an inclined guide member 31.

The housing 11 is composed of an upper shell 12 and a lower shell 19, both of which fit each other. The housing 11 includes an insertion entrance 13 located at a front end thereof for insertion of a card, a first sidewall 14 formed at a side therein, and a second sidewall and a third sidewall, both of which are located at the other opposite side therein (right) to the first sidewall 14. A narrow chamber 16 is defined at a rear section in the housing 11 and between the first and second sidewalls 14 and 15. A wide chamber 18 is defined at a front section in the housing 11 and between the first and third sidewalls 14 and 17.

The connection base 21 is mounted to a rear end in the housing 11, having a plurality of terminals 22 for corresponding connection with an inserted large or small E card.

The inclined guide member 31 is mounted to the wide chamber 18 and located close to the third sidewall 17.

The upper shell 12 has a guide piece 121 located above the wide chamber 18 and corresponding to and aligned with the second sidewall 15. The guide piece 121 has a front guide section 122 extending rearward and downward from the housing 11 toward the first sidewall 14 (leftward) for a predetermined length, a limit section 124 extending horizontally rearward from the front guide section for a predetermined length, and a rear guide section extending rearward and upward from the limit section toward the third sidewall 17 (rightward) for a predetermined length. In this embodiment, the guide piece 121 is formed in one piece with the upper shell 12. Each of the front and rear guide sections 122 and 126 has a guide portion R formed at one side thereof facing the first sidewall 14 for preventing the guide piece 121 from scratching the surface of a card during the insertion and extraction of the card and for preventing the front and rear guide sections 122 and 126 from deformation resulted from crashes of the card during the insertion and extraction of the card, further avoiding difficult insertion of the card if the guide piece 121 is deformed.

Figure 7:
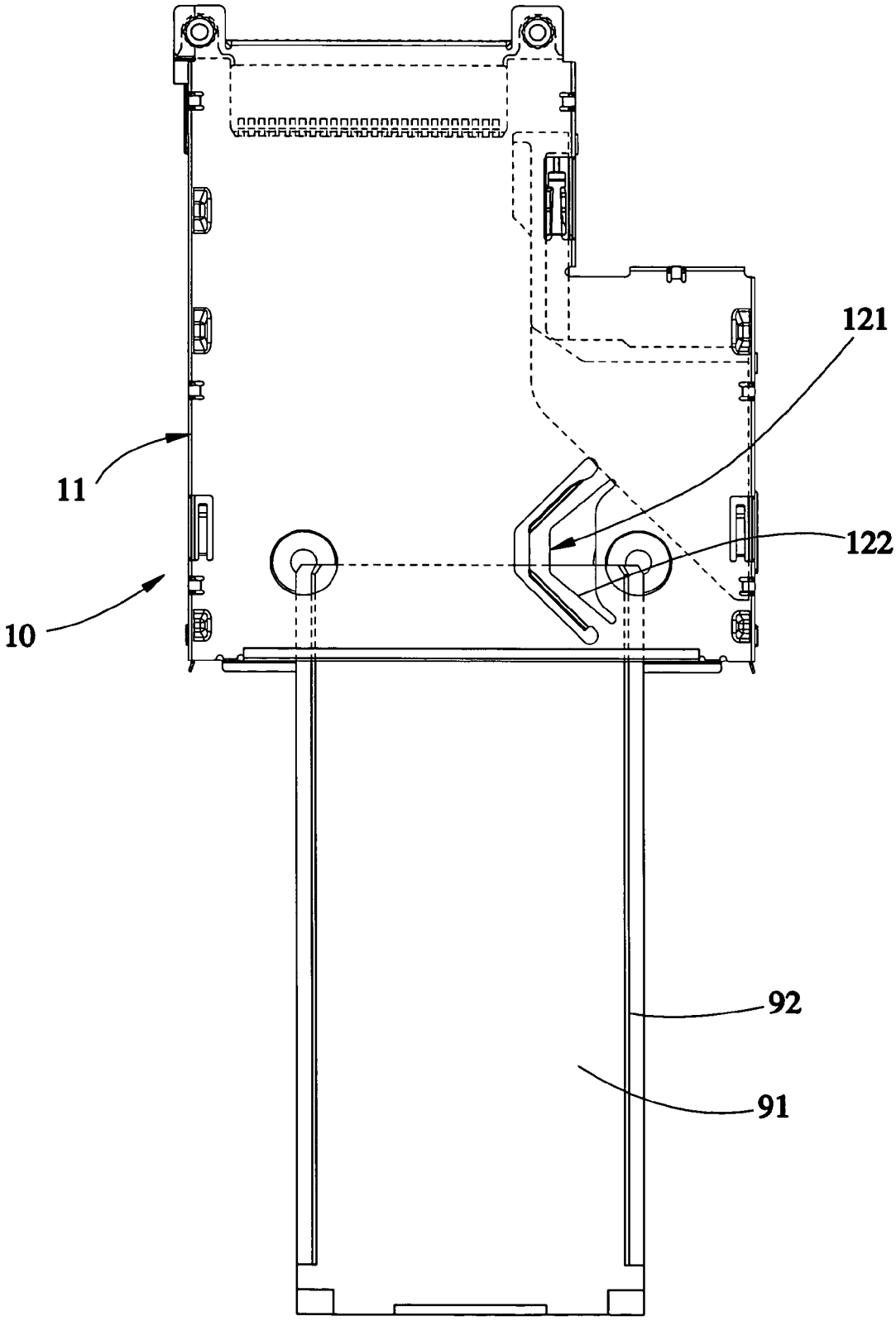
FIG. 7 is a top schematic view of the preferred embodiment of the present invention.
Figure 8:
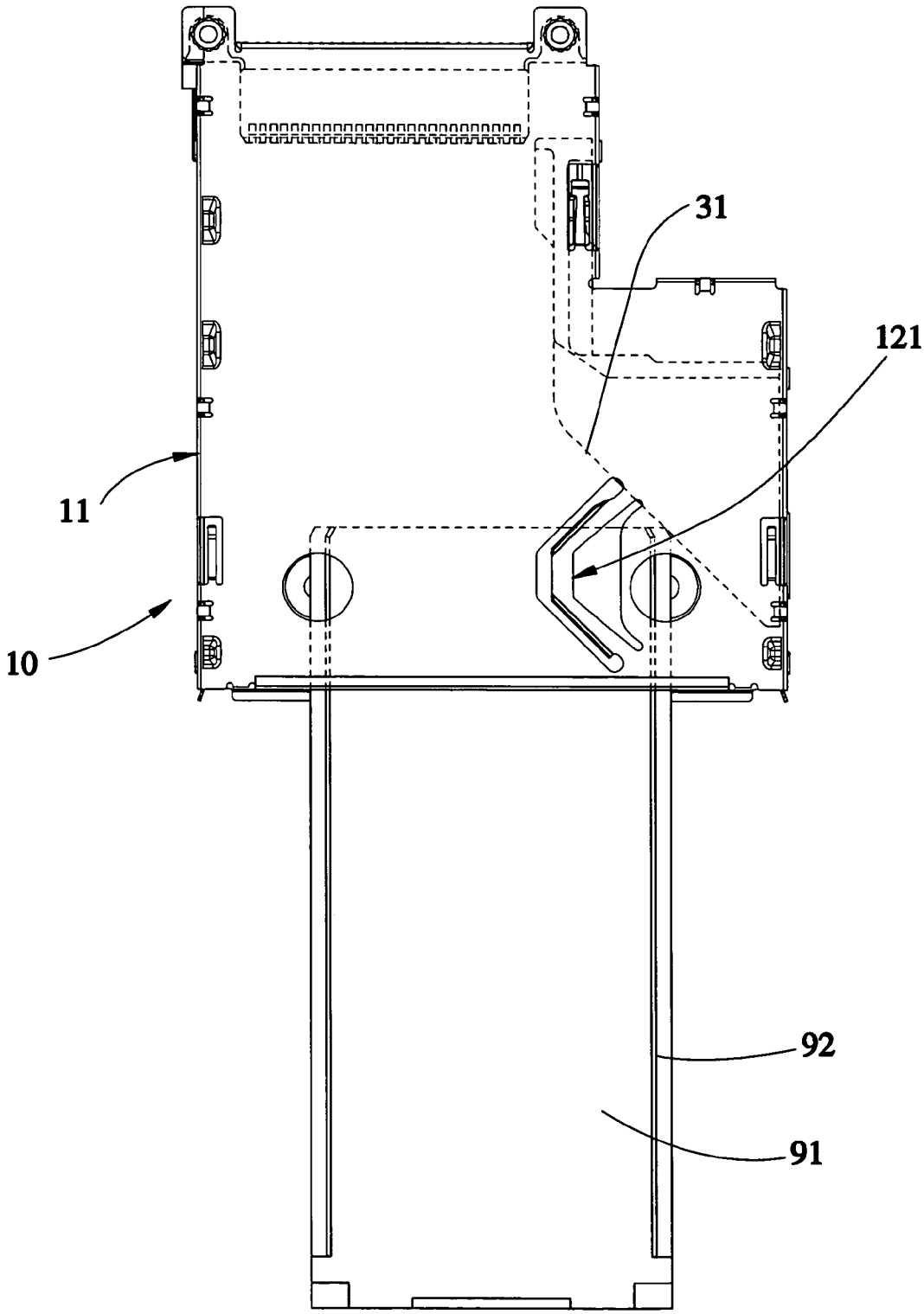
FIG. 8 is another top schematic view of the preferred embodiment of the present invention.
Figure 9:
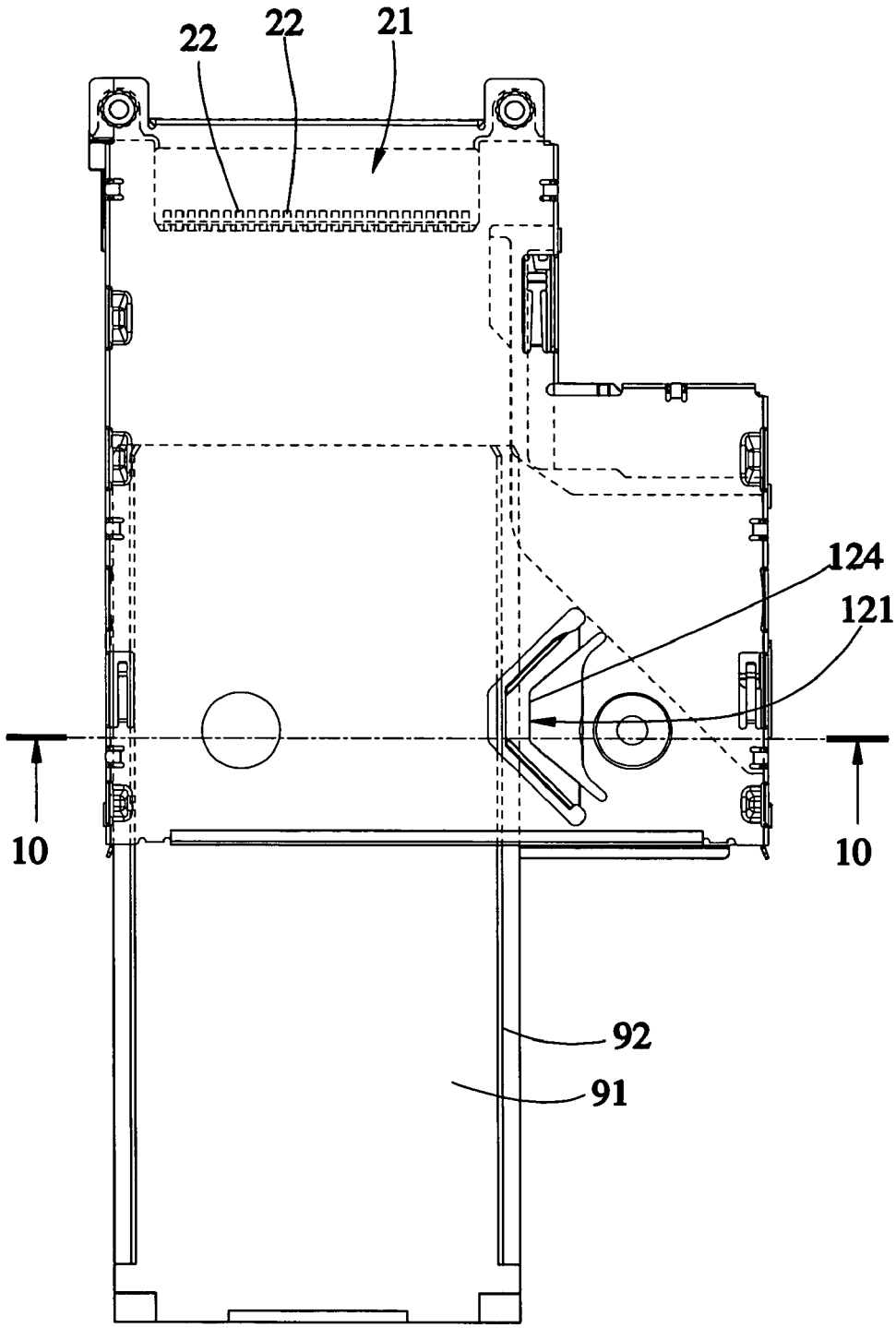
FIG. 9 is a top schematic view of the preferred embodiment of the present invention.
Figure 10:
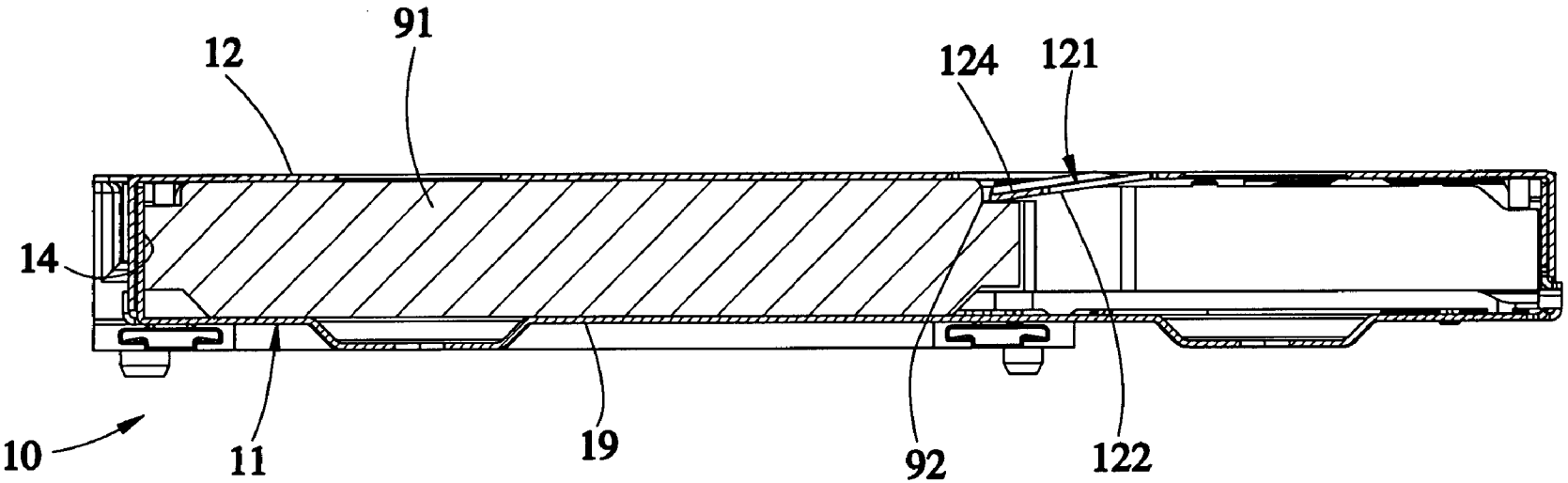
FIG. 10 is a sectional view taken along a ling 10-10 indicated in FIG. 9.
Figure 11:
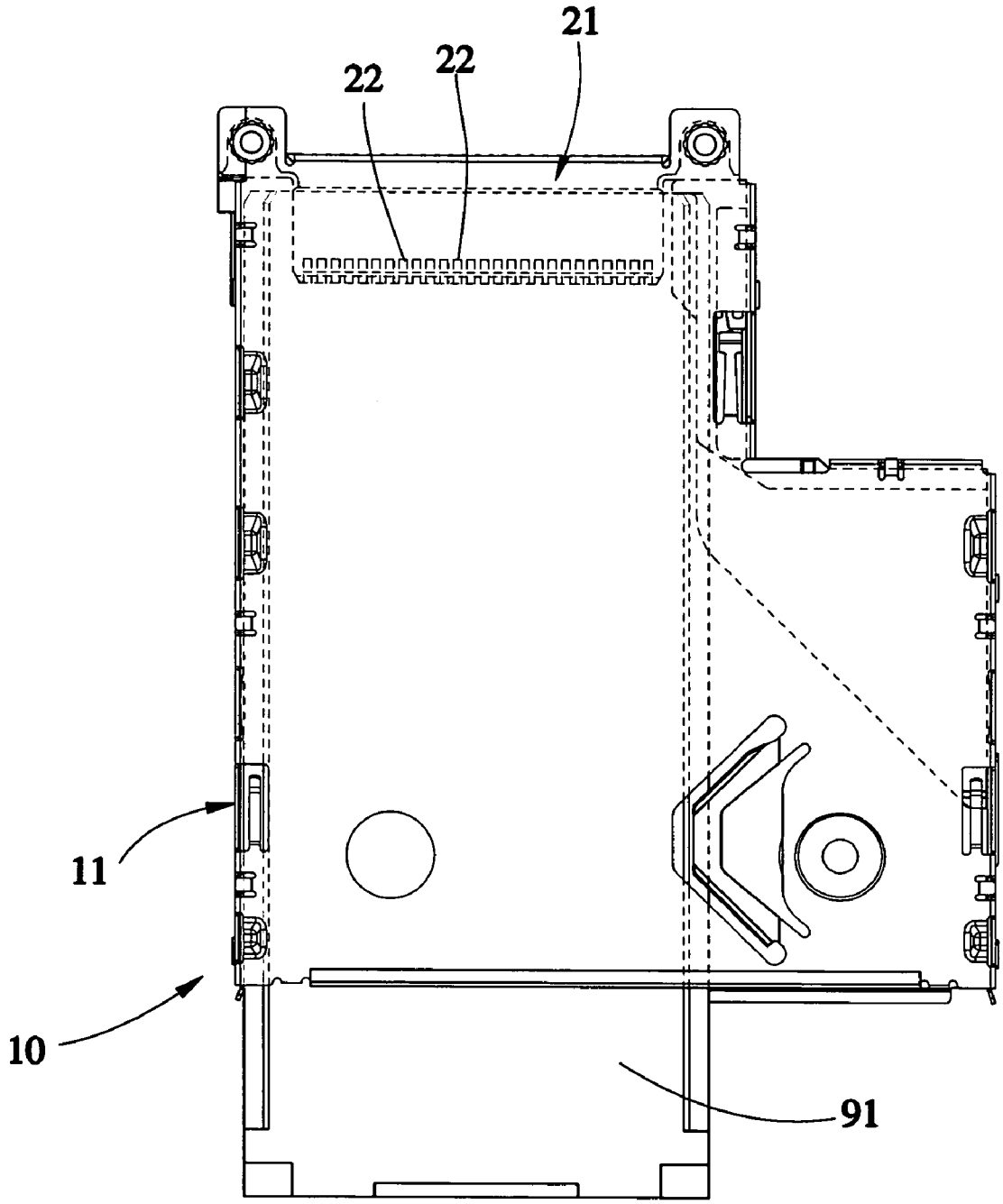
FIG. 11 is another top schematic view of the preferred embodiment of the present invention.

Referring to FIG. 7, during a non-left insertion of a small card 91 into the housing 11, a front upper side of the small card 91 first contacts the front guide section 122, and then the small card 91 can be raised by the front guide section 122 to continue to enter because the front guide section 122 leans rearward and downward opposite to the inserting direction of the small card 91. Referring to FIG. 8, while a front edge of the small card 91 contacts against the inclined guide member 31, the small card 91 leans leftward. Referring to FIGS. 9 and 10, while the small card 91 leans toward the leftmost side, the limit section 124 works on a stepped portion 92 formed on a right side of a top side of the small card 91. While continuing to be pushed inward, the small card 91 is limited by the limit section 124 and the first sidewall 14 to enter straight and finally be inserted to a rearmost end of the housing 11 to complete the insertion. After the small card 91 is inserted to the rearmost end of the housing 11, contact pins (not shown) of the small card 91 are connected with the terminals 22 of the connection base 21, as shown in FIG. 11.

Figure 3:
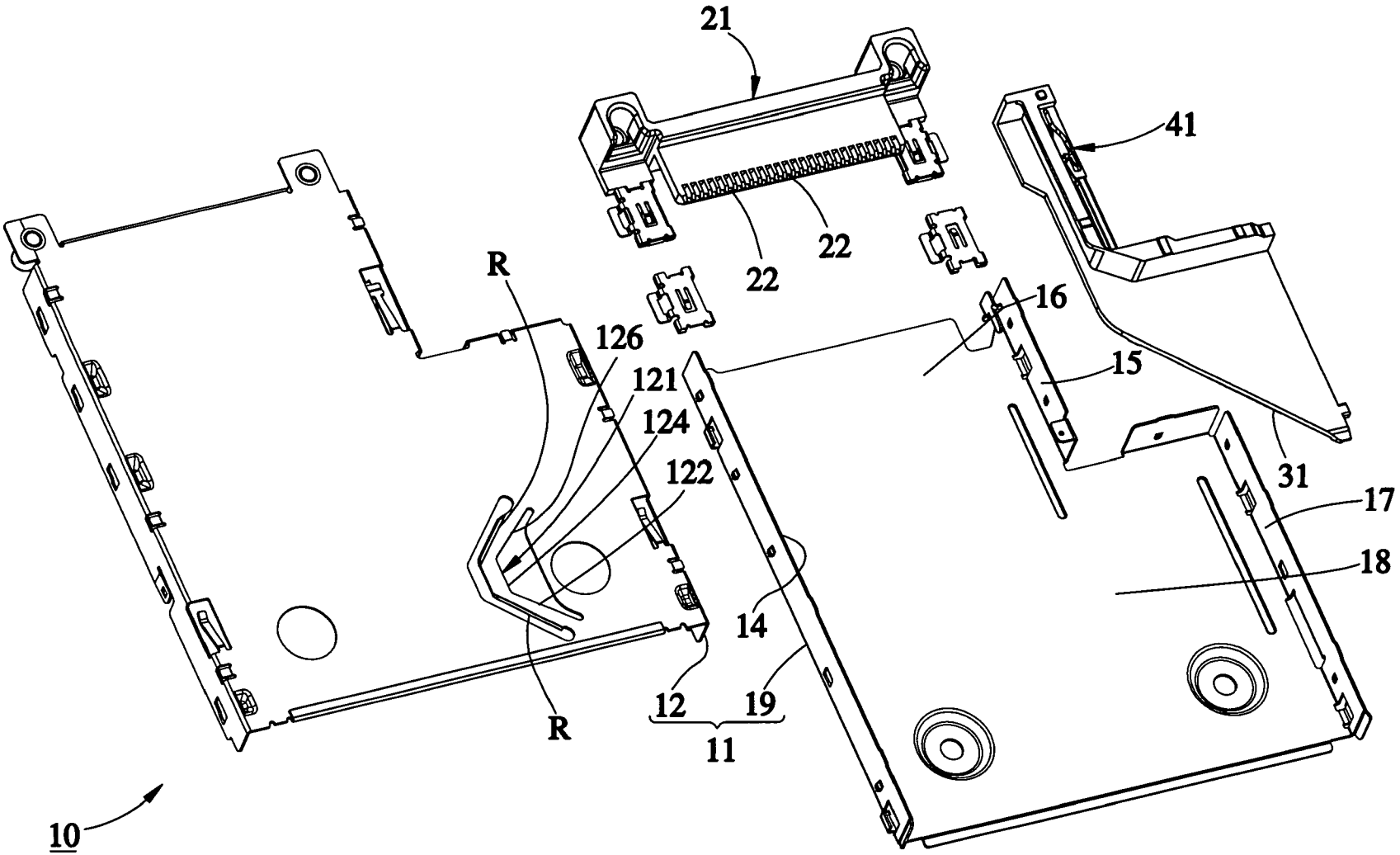
FIG. 3 is a perspective exploded view of the preferred embodiment of the present invention.
Figure 4:
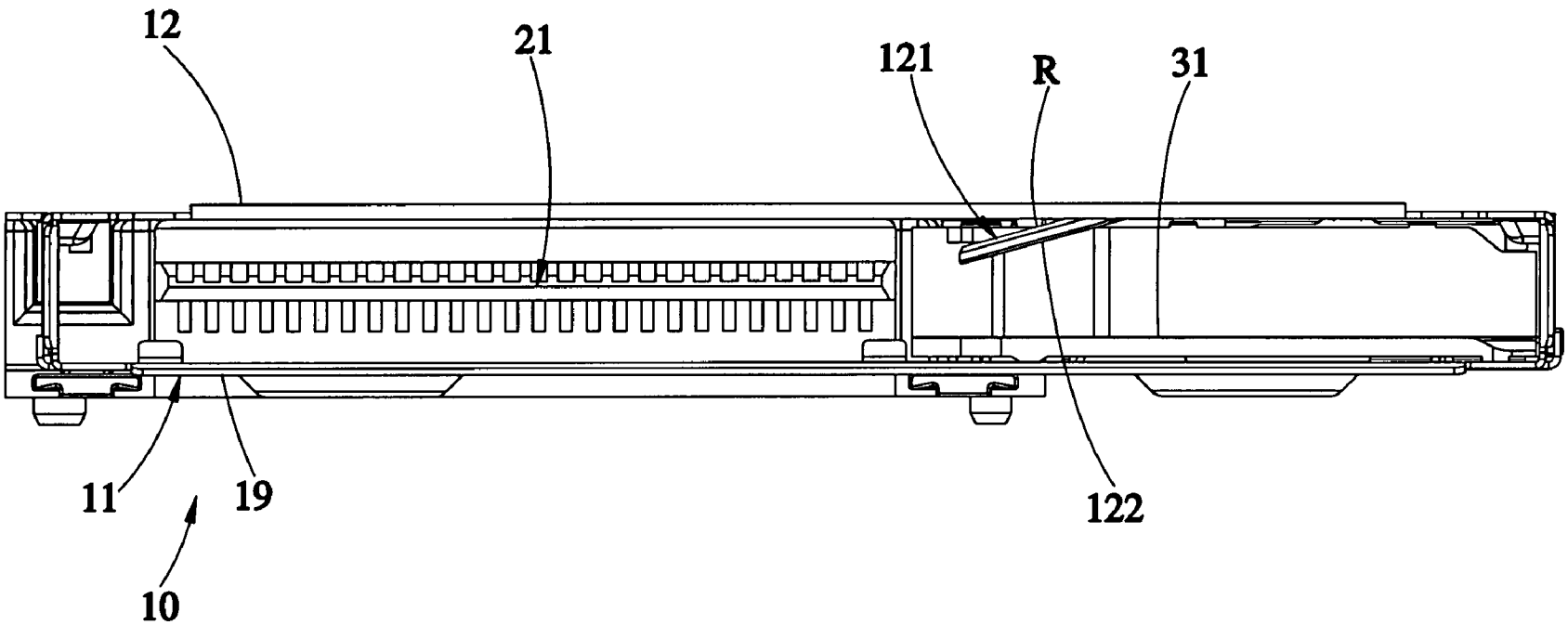
FIG. 4 is a front view of the preferred embodiment of the present invention.
Figure 5:
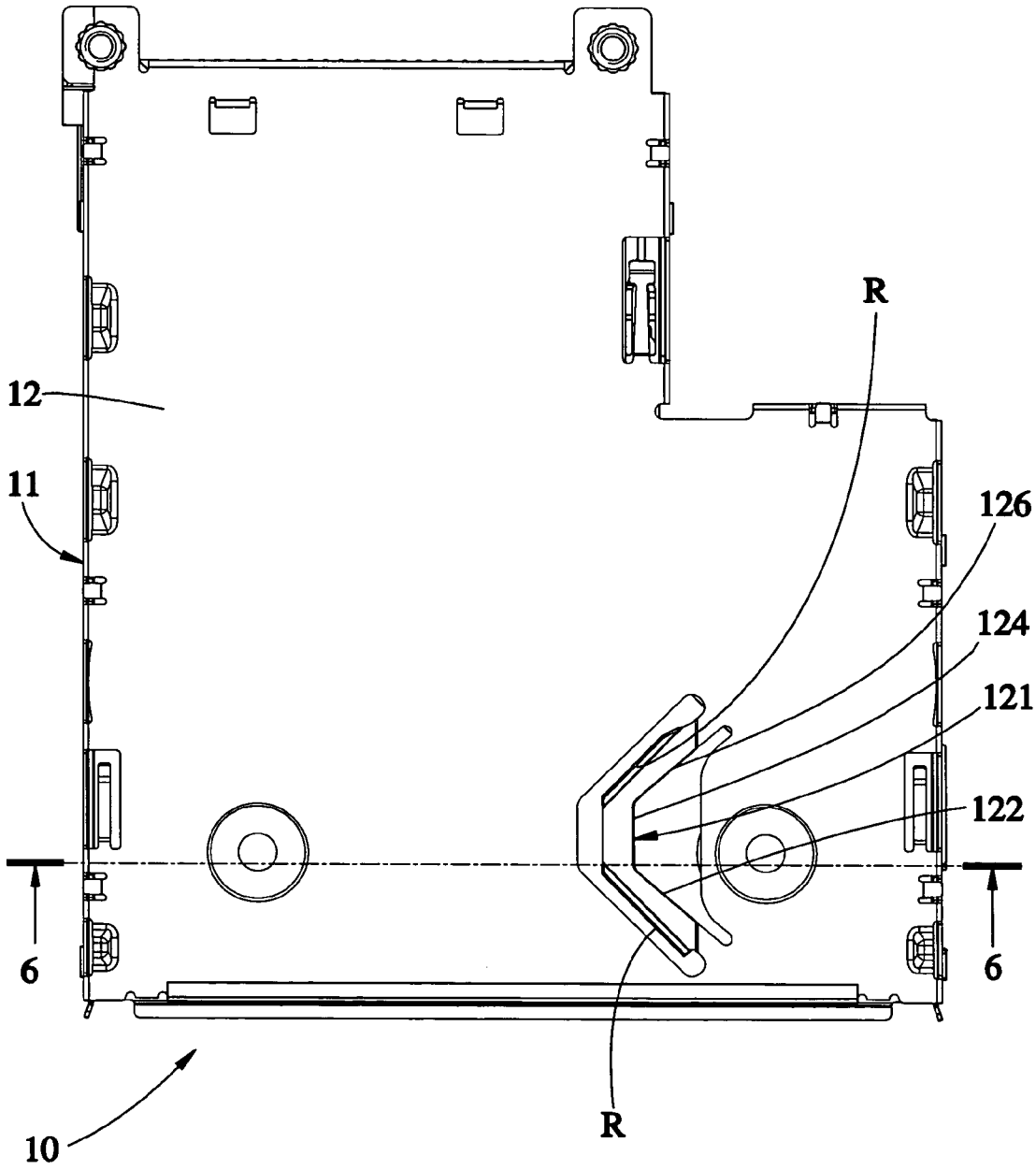
FIG. 5 is a top view of the preferred embodiment of the present invention.
Figure 6:
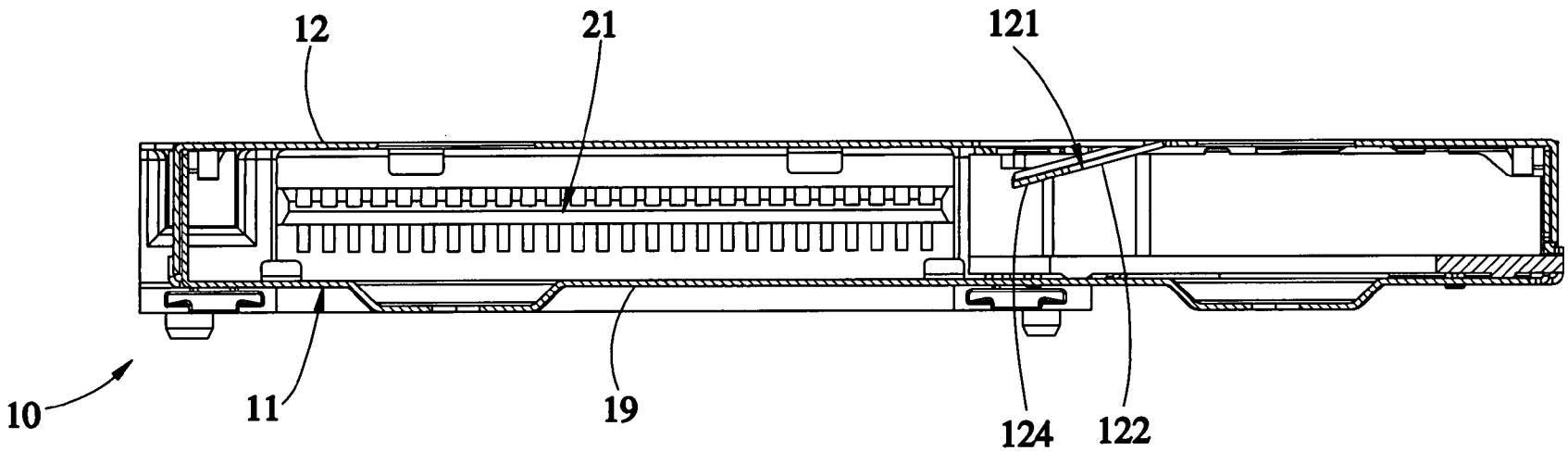
FIG. 6 is a sectional view taken along a ling 6-6 indicated in FIG. 5.

While intending to extract the small card 91, the user can directly pull out the small card 91 or eject the card by a conventional card-ejection mechanism, such as an injecting/ejecting member 41 shown in FIG. 3, which will not be detailed because its structure belongs to the prior art. During the ejection of the small card 91, a front edge of a top side of the small card 91 may have an unsmooth part and the rear guide section 126 can enable the unsmooth part of the small card 91 to work thereon and then the small card 91 likewise raises and passes through the guide piece 121, and finally the small card 91 is completely pulled out.

While the small card 91 is inserted left, the limit section 124 of the guide piece 121 works on the stepped portion 92 of the card 91 first and then the stepped portion 92 is limited between the first sidewall 14 and the limit section 124; meanwhile, the card 91 can only keep moving straightforward until full insertion into the housing 11, as shown in FIG. 9.

Since the insertion and extraction of the large E card can raise the guide piece 121 as the same status as those of the small card 91, no detailed description is necessary.

Known from the above, the present invention employs the guide piece 121 for guiding the small card 91 while inserted to enable more smooth and correct insertion of the card 91 and to avoid unsmooth insertion or extraction.

Although the present invention has been described with respect to a specific preferred embodiment thereof, it is no way limited to the details of the illustrated structures but changes and modifications may be made within the scope of the appended claims.

What is claimed is:

1. A card connector capable of guiding a small card, comprising:

a housing having an insertion entrance formed at a front end thereof, a first sidewall located at a side therein, a second sidewall, a third sidewall, a narrow chamber defined at a rear section therein and located between said first and second sidewalls, a wide chamber defined at a front section therein and located between said first and third sidewalls, and a guide piece located above said wide chamber and corresponding to said second sidewall, both of said second and third sidewalls being located at the other opposite side in said housing to said first sidewall, said guide piece having a front guide section extending rearward and downward from said housing toward said first sidewall for a predetermined length, a limit section extending horizontally rearward from said front guide section for a predetermined length, and a rear guide section extending rearward and upward from said limit section toward said third sidewall for a predetermined length, said rear guide section having a rear end connected with said housing;

a connection base mounted to a rear end in said housing and having a plurality of terminals; and an inclined guide member mounted to said wide chamber and located close to said third sidewall.

2. The card connector as defined in claim 1, wherein said guide piece is formed in one piece with said housing.

3. The card connector as defined in claim 2, wherein said housing comprises an upper shell and a lower shell, both of which fit each other; said guide piece is formed in one piece with said upper shell.

4. The card connector as defined in claim 1, wherein each of said front and rear guide sections of said guide piece comprises a guide portion formed at a side thereof facing said first sidewall.

* * * * *